United States Patent [19]

Boyer

[11] 4,031,807

[45] June 28, 1977

[54] ARMOURED ASSAULT CAR

[75] Inventor: Jean-Jacques Boyer, Montchauvet, France

[73] Assignee: Societe Anonyme Secmafer, Buchelay, Mantes, France

[22] Filed: Sept. 8, 1975

[21] Appl. No.: 611,334

[30] Foreign Application Priority Data

Sept. 20, 1974 France ..... 74.31830

[52] U.S. Cl. ..... 89/36 K; 89/40 B

[51] Int. Cl.[2] ..... F41H 7/02

[58] Field of Search ..... 89/36 H, 37 G, 40 B, 89/40 C, 40 P, 41 T, 41 CE; 180/6.48, 6.2, 9.32, 14 R, 22, 24.02, 44 F

[56] References Cited

UNITED STATES PATENTS

| | | | |
|---|---|---|---|
| 1,344,397 | 6/1920 | Holt | 89/40 B |
| 2,220,890 | 11/1940 | Cook | 89/36 H |
| 3,844,196 | 10/1974 | Taylor et al. | 89/41 CE |

FOREIGN PATENTS OR APPLICATIONS

| | | | |
|---|---|---|---|
| 504,610 | 7/1920 | France | 89/40 B |
| 966,693 | 10/1950 | France | 89/37 G |

*Primary Examiner*—Stephen C. Bentley
*Attorney, Agent, or Firm*—Young & Thompson

[57] ABSTRACT

An armoured assault car has a central chassis articulated at each of its two ends on a bogie chassis by a transverse shaft and a longitudinal shaft. At least one monitoring device acts between the central chassis and the chassis of one of the bogies for controlling the relative transverse slope of the central chassis relative to the bogie chassis about the longitudinal axis of the car. The gun turret of the car is mounted on the central chassis for pivotal movement about a horizontal axis that is perpendicular to the longitudinal axis of the central chassis. This horizontal axis is fixed relative to the central chassis, and the relative longitudinal slope between the gun turret and the central chassis is monitored so that the azimuth of the gun turret is maintained substantially constant.

10 Claims, 5 Drawing Figures

ARMOURED ASSAULT CAR

In the Patent Application filed June 5, 1975, under Ser. No. 583,907, for "Off-road vehicle," the applicant described an off-road vehicle comprising a central chassis articulated at each of its two ends to a bogie chassis by a transverse shaft, but also by a longitudinal shaft. The lateral inclination of the central chassis relative to at least one of the bogies is controlled by lateral jacks acting between the central chassis and the bogie chassis.

In an armoured assault car (tank) which may be constructed on the basis of such an off-road vehicle, it is vital, in order to increase the firing capacity to the maximum, to have a stable turret position independent of the undulations of the land. In general, the turret should remain horizontal and retain its orientation in the course of the manoeuvres of the vehicle.

The object of the present invention is to satisfy these conditions, and concerns an armoured assault vehicle or tank comprising a central chassis articulated at each of its two ends on a bogie chassis by a transverse shaft and a longitudinal shaft, with at least one monitoring device acting between the central chassis and the chassis of one of the bogies to control the transverse slope of the central chassis relative to the bogie chassis, in which at least the gun turret of the car is mounted on the central chassis by being articulated about an axis transverse to the longitudinal axis of this central chassis with means for monitoring the longitudinal slope between the gun turret and the central chassis.

According to a further feature, the relative distance between the longitudinal shaft of articulation of the central chassis on the bogie chassis and the plane of the bogie wheels is adjustable.

According to one embodiment of this feature, the transverse shaft between the central chassis and each bogie chassis is laterally supported by means making it possible to simultaneously vary the height of its central point and its transverse slope on the bogie chassis.

According to another feature, the gun turret is mounted to rotate on an armoured member having a shape of revolution about at least one transverse axis of the central chassis, the armoured member being rotatable about this axis.

According to one embodiment, the gun turret is connected to an armoured member comprising at least one part in the form of a spherical cap, the armoured element being able to turn relatively to the central chassis about two perpendicular axes, at least one of which is transverse to the longitudinal axis of the central chassis. According to another feature, the armoured member is formed by a plurality of elements in the form of cylindrical segments with their centre on the axis transverse to the central chassis, and capable of sliding relatively to each other, the gun turret being mounted to rotate, on the central segment, about an axis perpendicular to the transverse axis.

According to another embodiment, the armoured element 15 is formed by a plurality of cap-shaped and part spherical elements having the same centre and capable of sliding relatively to each other, the gun turret being mounted on the spherical capshaped element.

The rotation of the gun turret or the spherical cap-shaped element which supports it, is ensured by a hydraulic motor. The motors and jacks controlling the various relative movements and rotations between the turret, the members supporting the turret, the central chassis and the bogie chassis are under control of an inertia controlled constant position platform for maintaining the horizontal position and orientation of the turret.

Other features of the present invention and the advantages derived therefrom will become apparent from three embodiments described hereinafter with reference to the accompanying drawings, in which.

Figure 1:
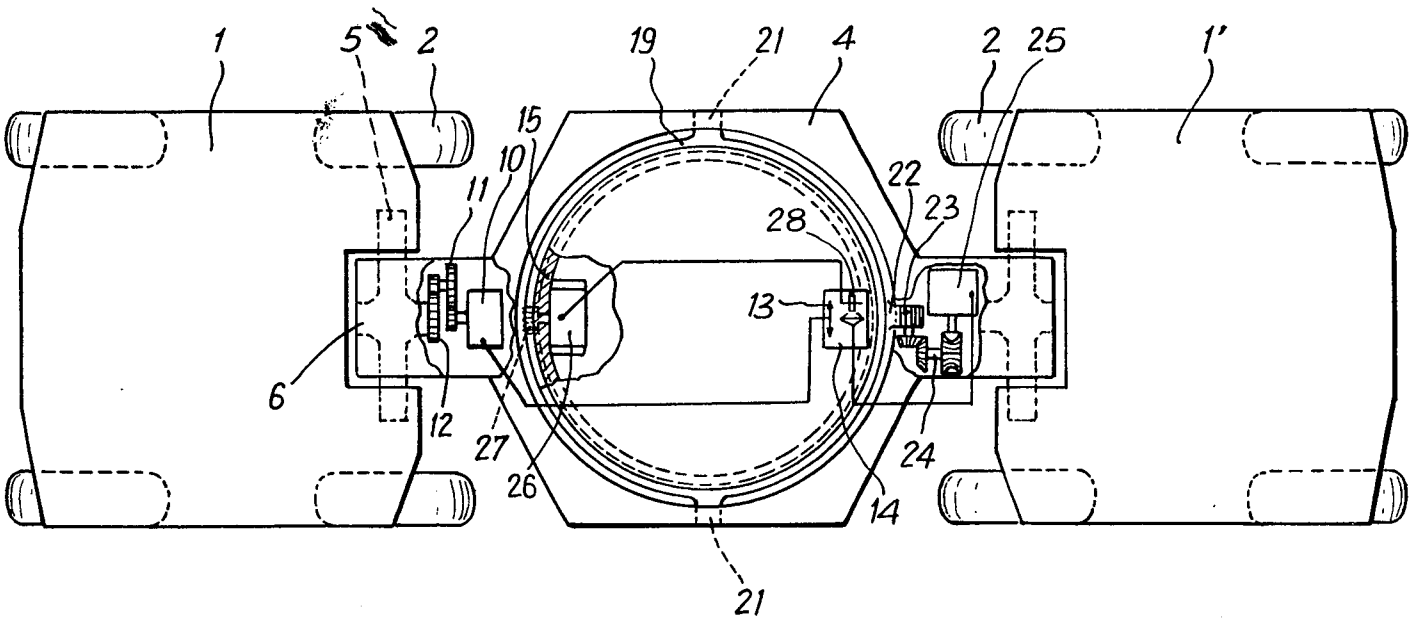
FIG. 1 is a fragmentary plan view of the armoured assault car according to a first embodiment.

The armoured assault car (tank) comprises, in the various embodiments, two bogies chassis 1 – 1', preferably mounted on wheels 2, but, if desired, on caterpillar tracks, and comprising drive units 3, in general of the hydraulic transmission type, with a central chassis 4 articulated on each bogie in the manner of a cardan shaft, by a transverse shaft 5 and a longitudinal shaft 6. The relative longitudinal inclination between each bogie chassis 1 and the central chassis 4 about the shaft 5 is controlled by a jack 7, this jack being also able to play the part of a shock absorber. According to a variant of the embodiment illustrated in FIG. 3 and in order to improve the protection of these control means, the jack is replaced by a gear mechanism 8 mounted on the end of the shaft 4 which itself is mounted to rotate on the bogie chassis, and the gear mechanism is driven by a motor 9, preferably hydraulic. The motor 9 may be mounted on the bogie chassis 1 by means of a shock absorber device (not shown) and the feed thereof manually controlled for the manoeuvres and/or automatically by a pressure difference detector on both axles.

Similarly, it is possible to control the transverse slope of the central chassis relative to at least one of the bogie chassis by means of jacks acting between the central chassis and the bogie chassis. According to a variant, this control is effected by a preferably hydraulic motor 10 driving, by means of a reduction gear 11, a pinion 12 keyed on the end of the shaft 6 which is itself mounted to rotate on the central chassis.

The feed of the motor 10 is monitored by a transverse horizontal position detector 13 forming part of an inertia controlled platform 14. The central chassis in this way maintains its transverse horizontal position whatever the transverse slope of the ground may be. The same horizontal position detector 13 could be used to control jacks capable of replacing the motor 10. The feed of the motor may also be manually controlled, for example, to obtain a line of fire descending laterally or, more generally, to obtain a lateral plane for the line of fire outside the angles of adjustment, on the vertical plane, of the gun on the turret or to adjust the plane of this line of fire when the gun is fixed on the turret. The means for adjusting the transverse slopes of the central chassis 1 is usually necessary only on one of the longitudinal articulations between the central chassis and one of the bogies, but it may be provided on both articulations to made it possible to control the distribution of loads between the pairs of lateral wheels and, for example, to remove the load from one of the sides, the wheels of which are sinking in soft ground or the tyres of which have burst.

Figure 2:
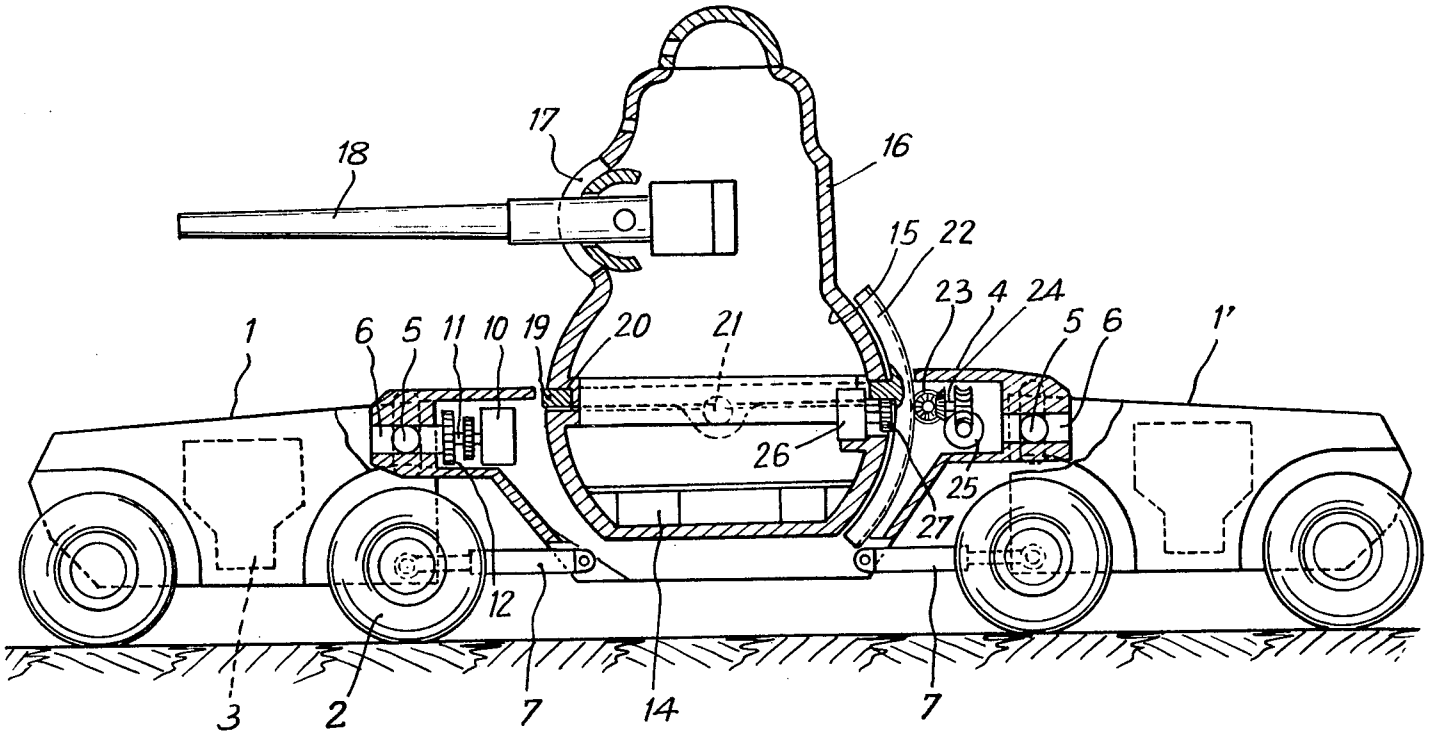
FIG. 2 is an elevational view in partial longitudinal section of the armoured assault car of FIG. 1.

In the embodiment shown in FIGS. 1 and 2, the gun turret forms a monolithic blockhouse comprising a lower portion in the form of a spherical segment 15 surmounted by a cylindrical turret 16 comprising a loophole 17 for the passage of the gun 18, observation loopholes and other similar items (not shown). The turret is mounted on the central chassis 4 by means of a crown 19 mounted to rotate in a recess 20 located on the large circumference of the part having the form of a spherical segment 15. This crown 19 is mounted to rotate on the central chassis 4 by two journals 21 located at the ends of the diameter perpendicular to the longitudinal axis of the central chassis. The crown 19 carries, on the other hand, at one of the ends of the diameter perpendicular to the axis of the journals, a toothed sector 22 which co-operates with a toothed pinion 23 driven, with the aid of a demultiplier gear 24, by a motor 25. The feed of the motor 25 is monitored by a longitudinal slope detector mounted on the inertia controlled platform 14 within the turret 16 so as to maintain, by co-operation with the device for maintaining the transverse position, the horizontal crown 19 horizontal, i.e. in order to keep the turret vertical. The toothed sector and pinion device could be replaced by a jack. The control of the device could also be ensured manually or by means of a firing control device associated with the inertia controlled platform 14.

The rotation of the turret about its vertical axis is ensured by a motor 26 connected to the turret and driving a toothed pinion 27 engaging with teeth provided on the lower face of the crown 19. The feed of the motor 26 is controlled by maintaining an automatic guiding device 28, provided on the inertia controlled platform to keep unchanged the orientation of the turret, notwithstanding the displacements of the vehicle. The feed control of the motor 26 may be simultaneously effected manually, if desired, for achieving the initial aiming of the gun.

Figure 3:
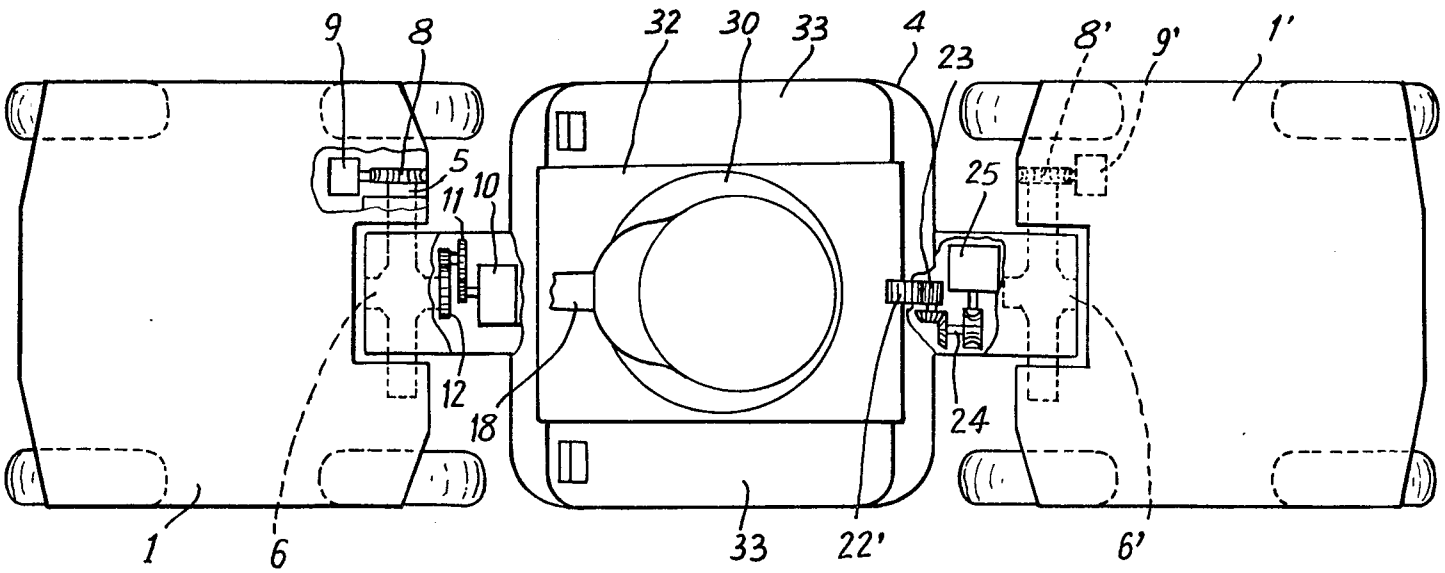
FIG. 3 is a plan view of a second embodiment.
Figure 4:
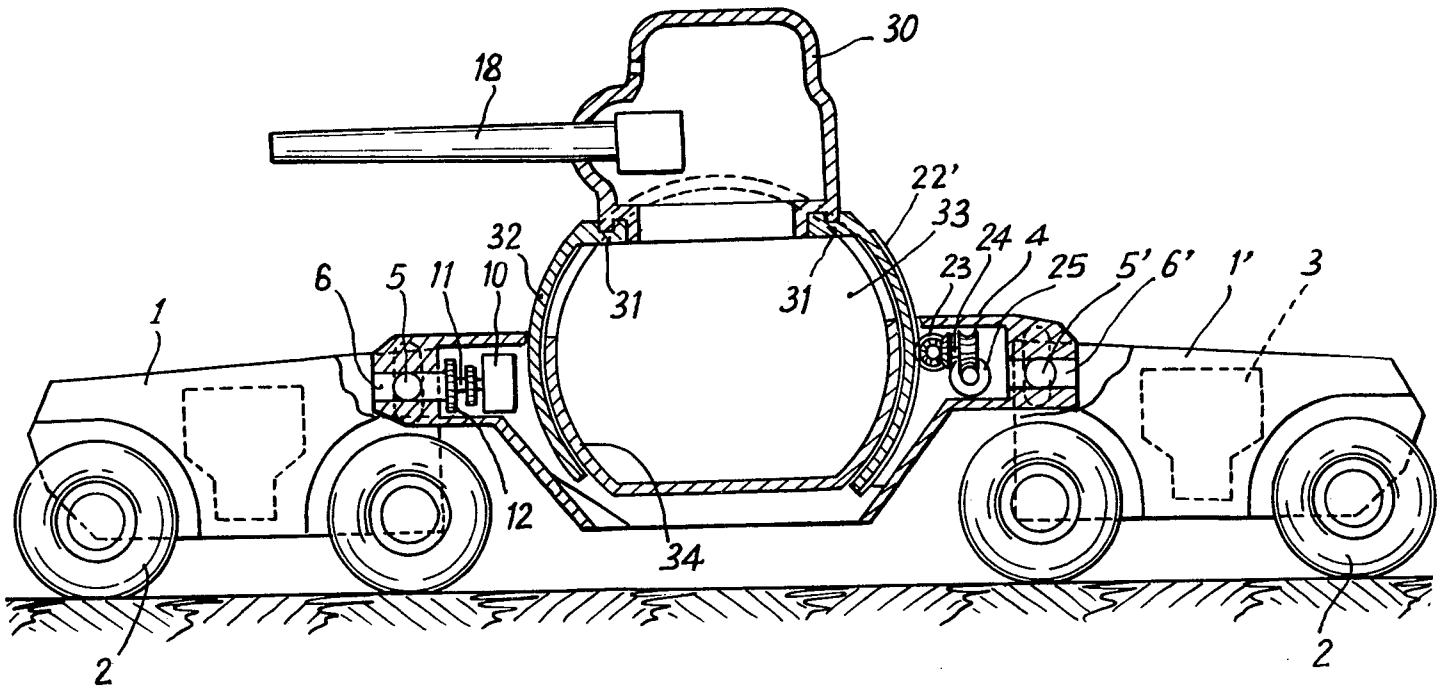
FIG. 4 shows a side view and partial section of the embodiment shown in FIG. 3.

In the embodiments shown in FIGS. 3 and 4, the same reference numerals as in FIGS. 1 and 2 have been used to indicate identical or similar members. However, the gun turret 30 is mounted to rotate by means of a motor having the same function as the motor 24 in the preceding embodiment and controlled in the same manner, but not shown, on a turret base 31 extending along the upper generating line of armour plating 32 in a cylindrical sector. The plate 22 engages at both its ends on fixed turret members 33, the vertical section of which is cylindrical and which close laterally, above the central chassis 1, the cockpit 34, the section of which is also in the form of a cylindrical sector. The turret is thus mounted to rotate about its vertical axis on the armour plate 32 which is able to turn about the axis common to the cockpit and the support armouring of the turret, said axis being perpendicular to the longitudinal axis of the central chassis. The rotation of the armour plate and the turret is controlled by a pinion 23 driven by the motor 25, the pinion 23 engaging with a rack 22′ provided on a guide vane of the periphery of the armour plate 32.

Figure 5:
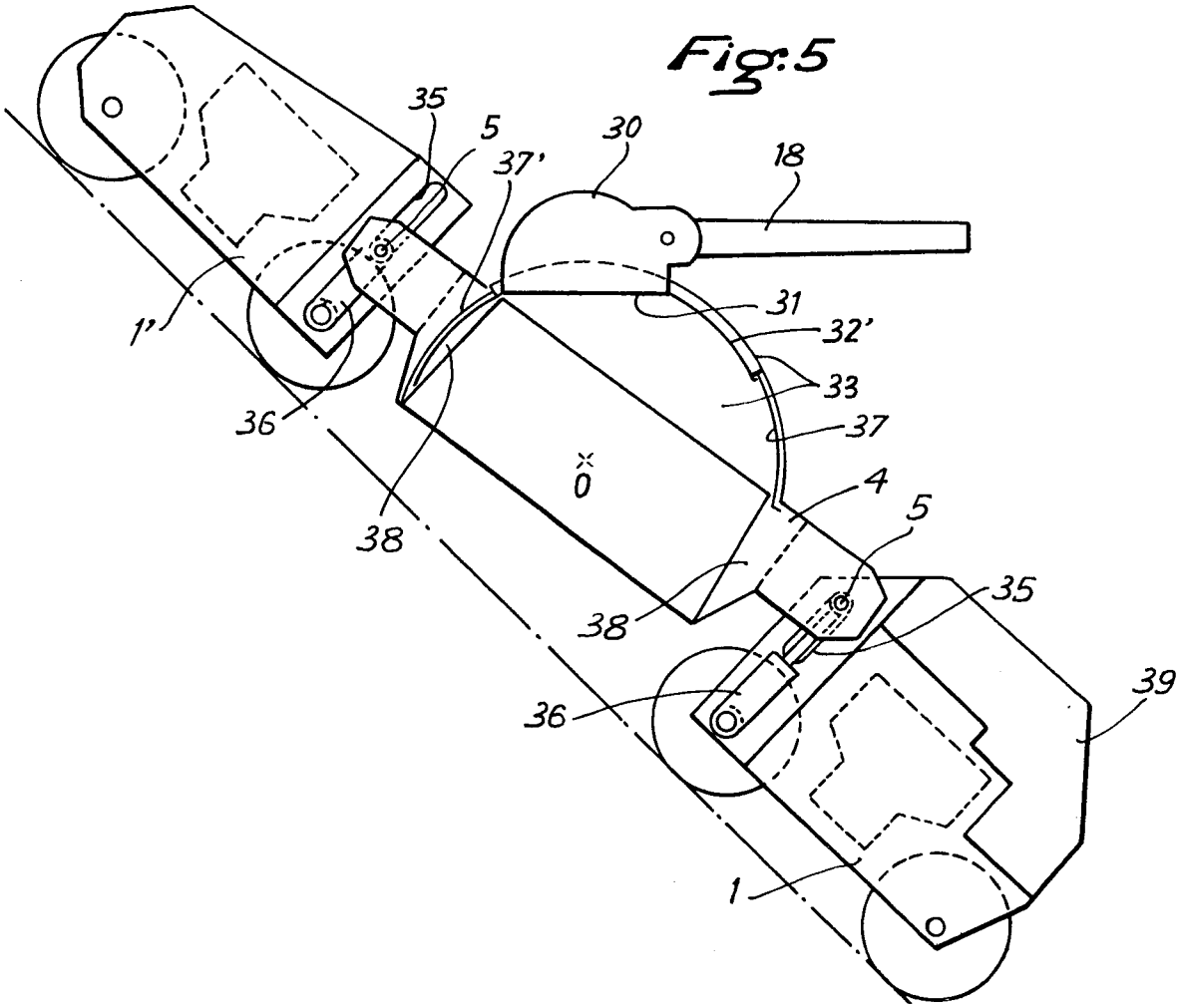
FIG. 5 shows a diagrammatic sectional view of a third embodiment.

In the embodiment shown in FIG. 5 the ends of the shafts 5 are guided in slides 35 and subjected to the action of jacks 36, the mounting being otherwise identical, namely, the shaft 5 forming, with a longitudinal shaft (not shown) a cardan shaft mounting of the main chassis on each bogie chassis. This method of assembling makes it possible, on the one hand, to compensate partially the slope as shown and therefore to reduce the angle of rotation of the turret about the transverse axis 0 which may be in a lower position, a feature which makes it possible to have a lower turret and to increase its dimension. Furthermore, the level of the central chassis may be lowered to increase stability in road traffic or to facilitate concealment or raised to increase its height above ground level or to permit firing over an obstacle. The difference in level of the two shafts 5 may be to compensate for gentle slopes whilst maintaining for the turret (which will be discribed hereinafter) its position ensuring double armour. The four jacks may also be used, if they are articulated by ball and socket joints on the shafts 5, to compensate for transverse differences in level.

The turret 30 is similar to that of the embodiment in FIGS. 3 and 4 i.e., it is mounted so that it can be orientated by rotation, due to the crown 31 on a protection plate having a cylindrical sector 32′. The angle of aperture of the cylindrical sector plate 32′ is limited, however, and it is completed by two other plates having cylindrical sectors 37, 37′ on which it can slide. The front and rear portions of the plate 32′ and the plates 37 – 37′ may be hidden in wells 38 provided at the front and rear of the cockpit 39. Preferably the plates 37 and 37′ are driven so as to emerge to the maximum from the well 38 to double the protection of the plate 32′, except in the extreme rotated position thereof shown in FIG. 5. Lateral protection of the cockpit is ensured by fixed lateral armour 33 as in the case of the embodiment in FIGS. 3 and 4. Rotation of the plate 32′ and the turret 30 about the axis 0 may be controlled by a motor or jacks operated as in the other embodiments. The plates 32′ and 37 – 37′ could also have the form of a spherical cap and a spherical zone respectively.

In the embodiment shown in FIG. 5, the front bogie has been diagrammatically illustrated as comprising a protected cockpit 39 which may represent a driving station with possibly a machine gun post. The same arrangement may also be adopted for the rear bogie.

The schematic embodiments described above by way of example may have many modifications without departing from the scope of the present invention.

What is claimed is:

1. An armoured assault car comprising a central chassis articulated at each of its two ends on a bogie chassis by a transverse shaft and a longitudinal shaft, with at least one monitoring device acting between the central chassis and the chassis of one of the bogies for controlling the relative transverse slope of the central chassis relatively to the bogie chassis, in which at least the gun turret of the armoured assault car is mounted on the central chassis whilst being articulated to pivot about an axis which is transverse to the longitudinal axis of the central chassis and fixed relative to the central chassis, with means for monitoring the relative longitudinal slope between the gun turret and the central chassis.

2. An armoured assault car according to claim 1, in which the relative distance between the longitudinal pivotal axis of the central chassis on the bogie chassis and the plane of the bogie wheels is adjustable.

3. An armoured assault car according to claim 2, in which the transverse shaft between the central chassis and each chassis of the bogie is supported laterally by means making it possible to vary simultaneously the height of its central point and its transverse incline on the bogie chassis.

4. An armoured assault car according to claim 1, in which the gun turret is mounted to rotate on an armoured member having a shape of revolution about at least one transverse axis of the central chassis, the armoured member being rotatable about this axis.

5. An armoured assault car according to claim 1 in which the gun turret is connected to an armoured member comprising at least one spherical cap shaped portion, whilst the armoured member may turn relatively to the cental chassis about two perpendicular axes, at least one of which is transverse relatively to the longitudinal axis of the central chassis.

6. An armoured assault car according to claim 4, in which the armoured member is formed by a plurality of elements in the form of cylindrical segments having their centre on the axis transverse relatively to the central chassis and capable of sliding relatively to each other, the gun turret being mounted to rotate on the central segment about an axis perpendicular to the transverse axis.

7. An armoured assault car according to claim 4, in which the armoured member is formed by one cap-shaped and several spherical zones shaped elements having the same centre and capable of sliding relatively to each other, the gun turret being mounted on the spherical cap-shaped element.

8. An armoured assault car according to claim 1, in which the rotation of the gun turret is effected by an hydraulic motor.

9. An armoured assault car according to claim 1, in which the motors and jacks controlling the various relative movements and rotations between the turret, the members supporting the turret, the central chassis and its bogie chassis are under control of an inertia controlled platform for maintaining the horizontal position and orientation of the turret.

10. An armoured assault car according to claim 5, in which the armoured member is formed by one cap-shaped and several spherical zone shaped elements having the same centre and capable of sliding relatively to each other, the gun turret bring mounted on the spherical cap-shaped element.

* * * * *